US010049840B2

(12) United States Patent
Gentsch et al.

(10) Patent No.: US 10,049,840 B2
(45) Date of Patent: Aug. 14, 2018

(54) POLE PART FOR HIGH PRESSURE ENVIRONMENT APPLICATION

(71) Applicant: ABB Schweiz AG, Baden (CH)

(72) Inventors: Dietmar Gentsch, Ratingen (DE); Dukkaiappan Subbiah Thevar, Duesseldorf (DE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/455,219

(22) Filed: Mar. 10, 2017

(65) Prior Publication Data

US 2017/0186574 A1 Jun. 29, 2017

Related U.S. Application Data

(63) Continuation of application No. PCT/EP2015/001821, filed on Sep. 10, 2015.

(30) Foreign Application Priority Data

Sep. 12, 2014 (EP) ..... 14003156

(51) Int. Cl.
*H01H 33/662* (2006.01)
*H01H 33/664* (2006.01)

(52) U.S. Cl.
CPC .... *H01H 33/66207* (2013.01); *H01H 33/664* (2013.01)

(58) Field of Classification Search
CPC ..... H01H 33/66207; H01H 33/664; H01H 2033/6623; H01H 2033/66223; H01H 33/662
USPC ..... 218/139, 134, 138, 155, 118
See application file for complete search history.

(56) References Cited

U.S. PATENT DOCUMENTS 3,471,669 A * 10/1969 Curtis ..... H01H 9/04 200/302.1
3,626,123 A 12/1971 Pflanz et al.
3,626,125 A * 12/1971 Tonegawa ..... G01M 3/202 200/61.03
3,787,649 A 1/1974 Erni et al.
(Continued)

FOREIGN PATENT DOCUMENTS

CN 101075509 A 11/2007
CN 202034297 U 11/2011
(Continued)

*Primary Examiner* — Renee Luebke
*Assistant Examiner* — William Bolton
(74) *Attorney, Agent, or Firm* — Leydig, Voit & Mayer, Ltd.

(57) ABSTRACT

A pole part for high pressure environment application, with a pressure resistant insulating housing in which a vacuum interrupter is installed, wherein the vacuum interrupter is provided with at least one moving contact and one fixed contact inside the vacuum interrupter. In order to create a pole part able to withstand high environmental pressure, a pressure resistant insulating body can be tubelike and at its ends provided with flanges formed at the insulating housing out of the same material, and that at least one of the flanges is closed with a metal cap, which is adapted to the aforesaid flange of the insulating housing by the same dimensions, and that with clamp the metal cap is pressed tightly on the flange of the insulating housing by the introduced clamping fixation force.

19 Claims, 1 Drawing Sheet

(56) References Cited

U.S. PATENT DOCUMENTS

| | | | | |
|---|---|---|---|---|
| 5,206,616 | A * | 4/1993 | Stegmuller | H01H 33/666 335/126 |
| 5,808,258 | A * | 9/1998 | Luzzi | H01H 33/66207 218/136 |
| 6,172,317 | B1 | 1/2001 | Wristen | |
| 8,653,398 | B2 * | 2/2014 | Gentsch | H01H 33/66207 218/154 |
| 8,785,802 | B2 * | 7/2014 | Shang | H01H 33/66207 218/120 |
| 2001/0025830 | A1 | 10/2001 | Allard et al. | |
| 2005/0063107 | A1 | 3/2005 | Benke | |
| 2009/0295155 | A1 | 12/2009 | Keller-Staub et al. | |
| 2013/0213938 | A1 * | 8/2013 | Bramhapurikar | H01H 33/66207 218/136 |
| 2013/0286546 | A1 | 10/2013 | Hazel et al. | |

FOREIGN PATENT DOCUMENTS

| | | | |
|---|---|---|---|
| DE | 569123 | C | 1/1933 |
| EP | 1139358 | A1 | 10/2001 |
| EP | 1331655 | A2 | 7/2003 |
| EP | 2565897 | A1 | 3/2013 |
| GB | 1206297 | A | 9/1970 |

* cited by examiner

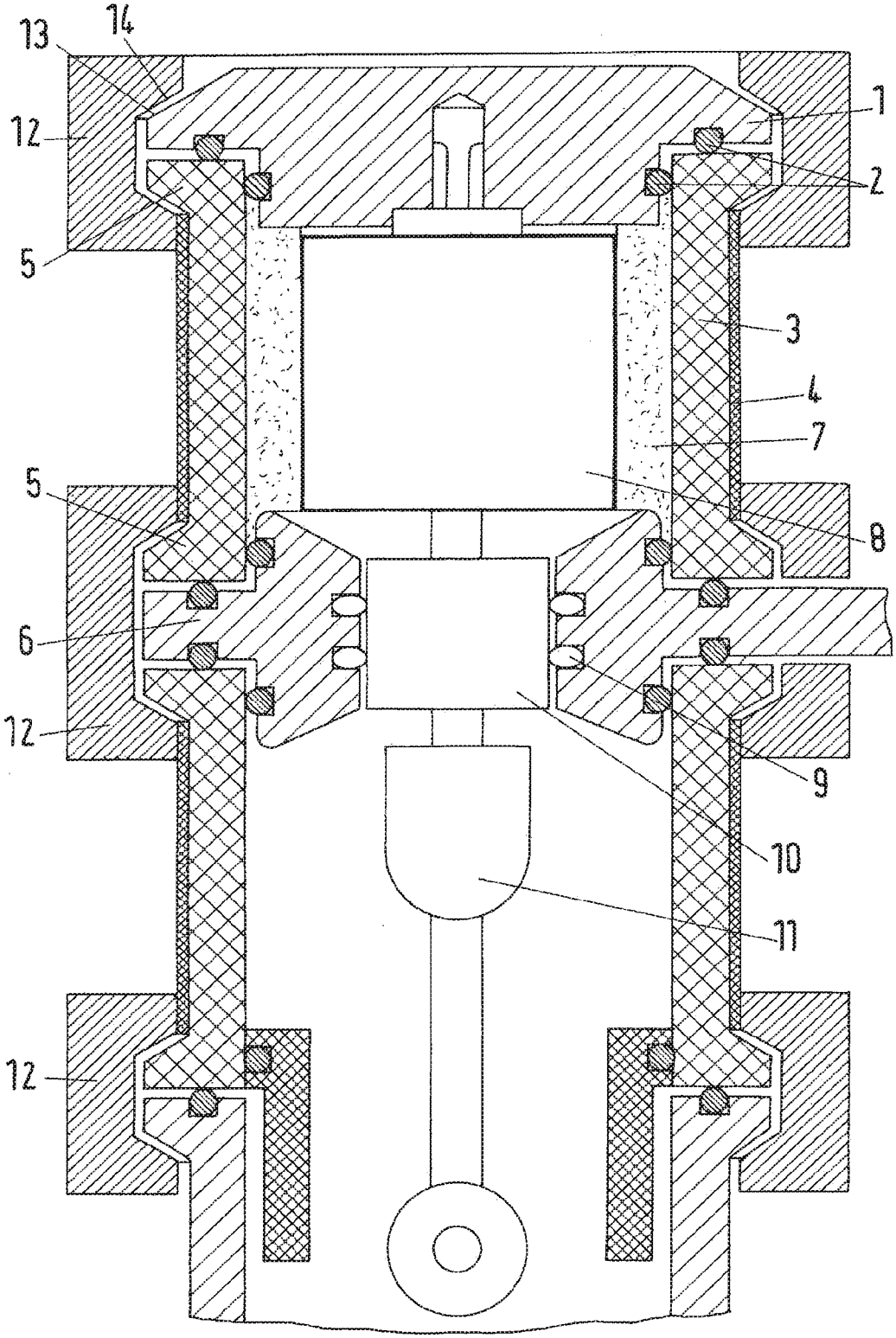
13
14
12
1
2
5
3
4
7
5
8
6
12
9
10
11
12

POLE PART FOR HIGH PRESSURE ENVIRONMENT APPLICATION

CROSS-REFERENCE TO RELATED APPLICATIONS

This application is bypass continuation of International Application No. PCT/EP2015/001821, filed on Sep. 10, 2015, and claims benefit to Europe Patent Application No. 14 003 156.8, filed on Sep. 12, 2014, the entire disclosure of each of which is hereby incorporated by reference herein. The International Application was published in English on Mar. 17, 2016, as WO 2016/037703 A1 under PCT Article 21(2).

FIELD

The invention relates to a pole part for high pressure environment application, with a pressure resistant insulating body in which a vacuum interrupter is installed.

BACKGROUND

Medium voltage vacuum interrupters are known to be used in high pressure environment, like in submarine application. The problem is a high pressure resistant housing of a normally ceramic vacuum interrupter.

SUMMARY

An aspect of the invention provides a pole part for high pressure environment application, the part comprising: a pressure resistant insulating housing in which a vacuum interrupter is installed, wherein the vacuum interrupter includes a moving contact and a fixed contact inside the vacuum interrupter, wherein the pressure resistant insulating housing is tubelike and at its ends include flanges formed on the insulating housing out of the same material, wherein at least one of the flanges, a first flange, is closed with a metal cap, wherein the metal cap is adapted to the first flange of the insulating housing by the same dimensions, and wherein, using a clamp, the metal cap is pressed tightly on the first flange of the insulating housing by an introduced clamping fixation force.

BRIEF DESCRIPTION OF THE DRAWINGS

The present invention will be described in even greater detail below based on the exemplary figure. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawing which illustrates the following:

FIG. 1 an embodiment of the invention having an embedded pole part based on a ceramic housing.

DETAILED DESCRIPTION

It is an aspect of the invention to create a pole part with high environmental pressure withstand with easier but much more effective constructive means.

In order to solve this requirement, an aspect of the invention is, that the pressure resistant insulating housing is tubelike and at its ends provided with flanges formed at the insulating housing out of the same material, and that at least one of the flanges is closed with a metal cap, which is adapted to the aforesaid flange of the insulating housing by the same dimensions, and that with clamping means the metal cap is pressed tightly on the flange of the insulating housing by the introduced clamping fixation force.

In a further advantageous embodiment, the flange of the insulating housing and the metal cap are provided with circumferential profiles in such, that the clamping fixation force of an at least two part clamp ring is diverted into an axial force pressing the flange and the cap tightly together. By that the housing is closed pressure tight with effective means.

In order to introduce high fixing forces at the flanges, the circumferential profile of the flange and the cap is shaped in such, that the thickness of the flange and the thickness of the cap will decrease towards the edge of the flange and the cap, and that the inner surface of the clamp ring means are formed complementarily to the aforesaid circumferential profiles of the flange and the cap, so that by reduction of the resulting diameter of a two part clamp ring an increase of the fixation force is introduced.

In a very advantageous embodiment, the insulating housing is made of ceramic or porcelain material.

This is for the aforesaid use in high environmental pressure important. To use under such condition ceramic or porcelain is not trivial, because the pressure tight closing has to be realized. So with the help of the aforesaid special clamping means between parts of different material like metal and ceramic or porcelain, this is possible.

A further advantageous embodiment is, that the tubelike insulating or ceramic housing is segmented into axial segments, which are fixed tightly together by aforesaid flanges with the aforesaid circumferential profiles and the clamping means. By that, diameter reducting forces of the clamp ring produces a axial force component between the flange-flange-and/or flange-cap-connection.

In a further advantageous embodiment is described, that concerning to the side, at which a moving stem of the moving contact extends out of the vacuum interrupter, the insulating or ceramic tubelike housing is devided into two axial segments, and that between these two segments of the housing a fixed contact ring of a sliding contact made of electrically conductive material is arranged, in order to electrically connect the moving contact of the vacuum interrupters moving contact with the fixed contact ring via a sliding contact.

Furthermore is described, that the fixed contact ring is provided with an integral ring, which extends in its diameter through the insulating housing arrangement in such, that it can be externally connected electrically.

In a further advantageous embodiment, the inner space of the housing, at least along the length of the vacuum interrupter is filled with potting material. This gives a further compensation of withstand of, that means against high pressure load from the environment.

Further advantageous in this construction is an embodiment in such, that the vacuum interrupter is provided at its fixed contact side with a bolt, which is carried in an integral stud hole in the metal cap.

In order to result a good sealing, between the flanges and between the flange and the metal cap are arranged elastic sealing rings, which are positionend in sealing grooves in the flanges and/or in the housing surface in the area which comes into mechanical contact with the cap or the contact ring.

Further advantageous embodiment is, that the insulating housing is covered with a rubber coating.

Advantageous are all features for the use in medium voltage.

Also useful is this in the use for low- or high voltage use.

The pressure tight construction of the pole part is advantageous for submarine use.

An embodiment of the invention is shown in FIG. 1 and described as follows.

FIG. 1 shows an embedded pole part based on a ceramic housing as a high pressure withstand, wherein the vacuum interrupter 8 is installed and provided with at least one moving contact and one fixed contact inside the vacuum interrupter, and with externally ending contact rod or push-rod 11, going through the ceramic of the vacuum interrupter. For contacting the vacuum interrupter 8 from outside, there are on both sides of the ceramic housing of the vacuum interrupter metal parts installed, on the fixed contact side a cap from the ceramic housing to the connection where the vacuum interrupter is connected.

At the other side of the housing there is a flange at the ceramic part provided which takes the connection between the movable side of the vacuum interrupter via a sliding contact system 9 to the middle part of the flange. Here the electrical connection takes place and the connection to the second insulation part, here the push rod will be installed.

In order to develop ceramic housing pole parts for the use under high pressure conditions for application at outer side submarine, an aspect of the invention is, that the housing of the insulating ceramic provides flanges where the metal parts are connected on top of the pole the lid or the cup of the part. At the middle side the connection is a flange between two ceramic parts and on the bottom side there is the connection to the breaker assembly. To keep both ceramics at the same length here a further plastic part can be installed and sealed to elongate especially at the movable side where the push rod is installed the insulation length. To get connection between the ceramic and the metal parts here are clamp rings installed. The vacuum interrupter can be kept in insulation gas or can be embedded inside a potting material to close the gap between housing and the vacuum interrupter. Here to get sufficient dielectrical performance and to get in case of need enough mechanical performance.

Furthermore the ceramic housing can be covered by a rubber material to avoid damage at the outer side of the housing during the submarine installation getting service.

Important are the regions at the flanges. So shown is a segmented housing made of ceramic material. In that case several ceramic housing segments are arranged in axial direction, so that the tubelike housing is segmented in axial direction.

The upper segment 3 is closed with a metal cap 1 in that way, that the inner side of the metal cap is structured in such, that it extends into the inner space in the housing, so that concentric sealing 2 are positioned in sealing grooves inside the metal cap.

So the metal cap 1 as well as the upper flange 5 are provided with thickness reduced areas at the edges. So the flanks of these thickness reduction are oriented in such, that the clamp ring 12 with a complementary inner structure 14 according to the edges of the flange 5 and the cap 1, can introduce an axial force to both parts, so that the cap 1 and the flange 5 are pressed towards each, when the clamp will be closed and fixed radially.

For that, the clamp ring 12 is divided into two half rings, connected at one point with a hinge. If the clamp ring will be closed at its open end, then the resulting diameter is reduced. Along this movement of fixation of the open ends of the clamp ring, the outer flanks of the flanges will be pushed strongly together by the compelementary inner flanks of the clamp ring.

By that a high axial tightening force can be introduced.

The lower side of the upper housing segment is also provided with a flange. This flange is pressed in the same way with a clamp ring corresponding to the edges with flanks to the counterpart, that means a further lower ceramic segment.

Important is, that between these flanges is positioned an extended metallic or electrically conductive ring, which is extended at least at one side over the outer surface of the ceramic segment, so that it can be contacted externally. This conductive ring is a part of the inner sliding contact of the vacuum interrupter moving contact.

The lower ceramic housing segment has flanges at both ends, so that a further lower housing segment can be added, in order to surround the push rod and the drive of the moving contact of the vacuum interrupter also pressure tightly.

So the lower end can also be closed by a metal cap, like shown at the upper end of the ceramic housing. Each further added housing segment is provided with the same flange-to-flange- and clamp-ring-arrangement like shown above. So the housing can be easily extended in its length, being adapted to each push-rod and/or drive construction.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

POSITION NUMBERING

1 metal cap
2 sealing
3 insulating housing, ceramic or porcelain
4 rubber coating or tube
5 flange
6 contact ring of the sliding contact
7 potting material
8 vacuum interrupter

9 sliding contact
10 piston
11 push rod
12 clamping means
13 edge of the metal cap
14 inner surface of the clamp ring

The invention claimed is:

1. A pole part for high pressure environment application, the part comprising:

a pressure resistant insulating housing in which a vacuum interrupter is installed, the pressure resistant insulating housing having ends, wherein the vacuum interrupter includes a moving contact and a fixed contact inside the vacuum interrupter, wherein the pressure resistant insulating housing is tube-shaped and at its ends includes flanges formed on the insulating housing out of a same material, wherein at least one of the flanges, a first flange, is closed with a metal cap, wherein the metal cap is adapted to fit the first flange of the insulating housing, wherein, using a clamp comprising a two part clamp ring with a first part and a second part, the metal cap is pressed tightly on the first flange of the insulating housing by an introduced clamping fixation force, wherein circumferential profiles of the first flange and the cap are shaped such that a first flange thickness and a cap thickness decrease towards a flange end and a cap end, and wherein an inner surface of the clamp is formed complementarily to the circumferential profiles of the flange and the cap such that, by reduction of a resulting diameter of the two part clamp ring, an increase of the fixation force is introduced.

2. The part of claim 1, wherein the clamp is configured to cause the clamping fixation force to be diverted into an axial force pressing the flange and the cap tightly together.

3. The part of claim 1, wherein the insulating housing includes a ceramic material.

4. The part of claim 1, wherein the insulating housing is segmented into axial segments, which are fixed tightly together by the flanges with circumferential profiles and the clamp.

5. The part of claim 4, wherein the insulating housing includes a ceramic.

6. The part of claim 1, wherein on a side at which a moving stem of the moving contact extends out of the vacuum interrupter, connected with a pushrod, the insulating housing is divided into two axial segments, and wherein, between the two axial segments, a fixed contact ring of a sliding contact including electrically conductive material is arranged, so as to electrically connect the moving contact of the vacuum interrupter with the fixed contact ring via the sliding contact.

7. The part of claim 6, wherein the fixed contact ring includes an integral ring having a diameter, the integral ring extending in its diameter through the insulating housing arrangement such that it can be externally connected electrically.

8. The part of claim 1, wherein an inner space of the housing, at least along a length of the vacuum interrupter, is filled with potting material.

9. The part of claim 1, wherein the vacuum interrupter, at a side having the fixed contact, includes a bolt, and wherein the bolt is carried in an integral stud hole in the metal cap.

10. The part of claim 1, further comprising:

elastic sealing rings, arranged between the flanges and between the first flange and the metal cap, wherein the elastic sealing rings are positioned in sealing grooves in the flanges and/or in the housing surface in an area which comes into mechanical contact with the cap or the contact ring.

11. The part of claim 1, wherein the insulating housing is covered with a rubber coating.

12. The part of claim 1, configured for medium voltage use.

13. The part of claim 1, configured for low- or high-voltage use.

14. The part of claim 1, configured for submarine use.

15. The part of claim 1, wherein the vacuum interrupter includes only one fixed contact.

16. The part of claim 1, wherein the insulating housing includes a porcelain material.

17. A pole part for high pressure environment application, the part comprising:

a pressure resistant insulating housing in which a vacuum interrupter is installed, the pressure resistant insulating housing having ends, wherein the vacuum interrupter includes a moving contact and a fixed contact inside the vacuum interrupter, wherein the pressure resistant insulating housing is tube-shaped and at its ends includes flanges formed on the insulating housing out of a same material, wherein at least one of the flanges, a first flange, is closed with a metal cap, wherein the metal cap is adapted to fit the first flange of the insulating housing, wherein, using a clamp, the metal cap is pressed tightly on the first flange of the insulating housing by an introduced clamping fixation force, wherein the first flange and the metal cap include circumferential profiles such that the clamp, including a clamp ring including a first part and a second part, causes the clamping fixation force to be diverted into an axial force pressing the flange and the cap tightly together, wherein the circumferential profiles of the first flange and the cap are shaped such that a first flange thickness and a cap thickness decrease towards a flange end and a cap end, and wherein an inner surface of the clamp is formed complementarily to the circumferential profiles of the flange and the cap such that, by reduction of a resulting diameter of a two part clamp ring, an increase of the fixation force is introduced.

18. A pole part for high pressure environment application, the part comprising:

a pressure resistant insulating housing in which a vacuum interrupter is installed, the pressure resistant insulating housing having ends, wherein the vacuum interrupter includes a moving contact and a fixed contact inside the vacuum interrupter, wherein the pressure resistant insulating housing is tube-shaped and at its ends includes flanges formed on the insulating housing out of a same material, wherein at least one of the flanges, a first flange, is closed with a metal cap, wherein the metal cap is adapted to fit the first flange of the insulating housing, wherein, using a clamp, the metal cap is pressed tightly on the first flange of the insulating housing by an introduced clamping fixation force, wherein on a side at which a moving stem of the moving contact extends out of the vacuum interrupter, connected with a pushrod, the insulating housing is divided into two axial segments, and wherein, between the two axial segments, a fixed contact ring of a sliding contact including electrically conductive material is arranged, so as to electrically connect the moving contact of the vacuum interrupter with the fixed contact ring via the sliding contact.

19. The part of claim 18, wherein the fixed contact ring includes an integral ring having a diameter, the integral ring extending in its diameter through the insulating housing arrangement such that it can be externally connected electrically.

* * * * *